US008756898B1

(12) United States Patent
Backhaus et al.

(10) Patent No.: US 8,756,898 B1
(45) Date of Patent: Jun. 24, 2014

(54) APPARATUS AND METHOD FOR JOINING ADJACENT CONCRETE PANELS

(71) Applicants: Thomas J. Backhaus, McLean, NE (US); Baltazar Siqueiros, San Dimas, CA (US)

(72) Inventors: Thomas J. Backhaus, McLean, NE (US); Baltazar Siqueiros, San Dimas, CA (US)

( * ) Notice: Subject to any disclaimer, the term of this patent is extended or adjusted under 35 U.S.C. 154(b) by 0 days.

(21) Appl. No.: 13/795,952

(22) Filed: Mar. 12, 2013

(51) Int. Cl.
*E04B 5/00* (2006.01)

(52) U.S. Cl.
USPC ..... 52/745.2; 52/747.1; 52/585.1; 52/125.5; 404/47; 404/73

(58) Field of Classification Search
USPC ..... 52/592.1–585.1, 745.19, 747.1, 745.2, 52/747.11, 741.41, 742.12, 742.13, 52/742.14, 125.5, 127.4, 127.7, 583.1; 404/17, 47–51, 60, 62, 63, 72–74, 52, 404/57
See application file for complete search history.

(56) References Cited

U.S. PATENT DOCUMENTS

| | | | | |
|---|---|---|---|---|
| 4,883,385 | A * | 11/1989 | Kaler | 404/47 |
| 5,586,834 | A | 12/1996 | Tsuji | |
| 7,134,805 | B2 * | 11/2006 | Yee | 404/50 |
| 7,677,832 | B2 * | 3/2010 | Yee | 404/40 |
| 8,007,199 | B2 * | 8/2011 | Shaw et al. | 404/74 |
| 8,209,933 | B2 * | 7/2012 | Law | 52/585.1 |
| 8,479,471 | B2 * | 7/2013 | Liberman | 52/741.1 |
| 8,511,931 | B2 * | 8/2013 | Klotz et al. | 404/40 |

* cited by examiner

*Primary Examiner* — Jeanette E. Chapman
(74) *Attorney, Agent, or Firm* — Morland C. Fischer

(57) ABSTRACT

An apparatus and a method by which a plurality of connecting rods are located within and slidable through a first concrete panel so that the connecting rods extend outwardly from the first panel for receipt inwardly of a second concrete panel at mating channels formed therewithin, whereby the first and second concrete panels are joined together such as, for example, in the case of roadway construction. A plurality of slots which are formed through the top of the first panel communicate with respective ones of the plurality of connecting rods. A tool is moved into contact with the connecting rods by way of respective ones of the slots. The tool applies a pushing force to each of the connecting rods to cause the rods to slide through the first panel and into receipt by the mating channels of the second panel to establish a reliable joint therebetween.

16 Claims, 5 Drawing Sheets

APPARATUS AND METHOD FOR JOINING ADJACENT CONCRETE PANELS

BACKGROUND OF THE INVENTION

1. Field of the Invention

This invention relates to a plurality of connecting rods that are embedded within a concrete panel or slab and to a method for sliding the rods through the concrete panel and into receipt by an adjacent concrete panel or slab in order to form a reliable joint by which to connect the panels to one another. The apparatus and method have particular application in roadway construction and/or repair where several panels must be laid end-to-end (and/or side-by-side) and connected one to the next so as to construct a continuous roadway to support vehicular traffic.

2. Background Art

As new communities are built, it is essential to have a roadway system to link each community with neighboring communities. Therefore, a series of highways and freeways are constructed to support vehicular traffic. A common technique for building such roadways is to lay a number of heavy precast concrete panels or slabs end-to-end and side-by-side one another. However, all of the panels must be level and reliably connected one to the next in order to establish a smooth and continuous driving surface.

A conventional technique to connect a first concrete panel to an adjacent panel is by means of dowel bar joints. A series of surface grooves are formed in opposing ends of each of the first and adjacent panels. The surface grooves between the panels are axially aligned. A corresponding set of dowel bars are simply laid in respective ones of the surface grooves so that each dowel bar extends between the first and adjacent panels. The surface grooves are filled in order to cover and hold the dowel bars in place. The dowel bars are intended to connect the panels together and prevent shifting and a separation of one panel from the other.

However, over time, heavy wear, changing weather patterns, and movement of the earth bed upon which the roadway is constructed, mechanical forces are applied to the ends of the panels which may cause the dowel bar joints between adjacent panels to loosen. By way of particular example, the panels may experience thermal expansion or contraction and move relative to one another as a result thereof. In this case, the panels may buckle such that the bars will be dislodged from the grooves in which they are located. Consequently, the surface-mounted dowel bars may pop out of the roadway to not only create a potentially hazardous driving surface but to also permit gaps to form and widen between adjacent panels. Such gaps can adversely affect the integrity of the entire roadway and require frequent and expensive repairs.

Therefore, what is desirable is a more reliable joint by which to overcome the aforementioned problems inherent with the use of the conventional dowel bars and be able to accommodate a movement or shifting of an adjacent pair of concrete panels in order to ensure a stable and long-term end-to-end connection of one panel to the next.

SUMMARY OF THE INVENTION

In general terms, disclosed herein are an apparatus and method by which one panel or slab is joined end-to-end (or side-by-side) to an adjacent panel. According to a preferred embodiment, the panel to which the apparatus and method relate is a pre-cast concrete panel of the kind that is typically used with other panels in the construction of a roadway (e.g., freeway) to support vehicular traffic.

Each concrete panel has a plurality of deep slots formed through the top and disposed along a first end thereof. A plurality of connecting rods at the first end of the concrete panel are accessible by way of the deep slots. The plurality of connecting rods are axially aligned with a corresponding plurality of mating channels that are disposed along an opposing end of an adjacent concrete panel. Each of the plurality of connecting rods is slidable through and outwardly from respective ones of the plurality of slots formed in a first panel for receipt by an axially-aligned mating channel formed in the adjacent panel. More particularly, a hand-held tool (e.g., an elongated bar) is inserted downwardly through each of the plurality of slots so as to apply a pushing force to the front end of each of the plurality of connecting rods, whereby to push the opposite rear end of each rod outwardly from the first panel and into receipt by an axially-aligned mating channel in the adjacent panel, whereby the first and adjacent panels will be reliably connected together.

During manufacture of the panel, but prior to casting, one of a plurality of slot formation blocks is suspended within a mold frame by seating the block on the front end of one of the plurality of connection rods which extends into one end of the frame. One of a corresponding plurality of depression cylinders is moved into the opposite end of the frame so as to be axially aligned with the connection rod. An injection opening tube is detachably connected to the top of each depression cylinder at the top of the frame. The frame is now filled with concrete, or the like, which surrounds each one of the connection rods, the slot formation blocks and the depression cylinders.

After the concrete has set but prior to it being fully cured, each slot formation block, depression cylinder, and injection opening tube is withdrawn from the frame within which the concrete has been poured. Removing the slot formation blocks creates the plurality of deep slots through the top of the panel through which the aforementioned tool is moved in order to apply a force to push each of the connecting rods outwardly from the first concrete panel and into the second panel. Removing the depression cylinders creates within the concrete panel the plurality of mating channels into which the rear ends of the connecting rods are pushed. Removing the injection opening tubes creates injection ports through the top of the concrete panel which communicate with the mating channels.

When all of the connecting rods that are accessible through the plurality of slots formed in the first panel are pushed into slidable receipt by axially-aligned ones of the plurality of coupling channels formed in the adjacent panel, the pluralities of slots and coupling channels are pumped full of grout or another suitable filler material. Accordingly, the connecting rods are now fully embedded within and extended between opposing ends of first and adjacent concrete panels in order to establish reliable joints that are unlikely to be dislodged over time. The connecting rods retain the panels connected one to the other and accommodate a slight movement of the panels towards one another or apart in response to thermal expansion or contraction. That is the adjacent panels can slide along the connecting rods so as to advantageously avoid buckling and cracking due to changing environmental conditions.

DESCRIPTION OF THE PREFERRED EMBODIMENT

Figure 1:
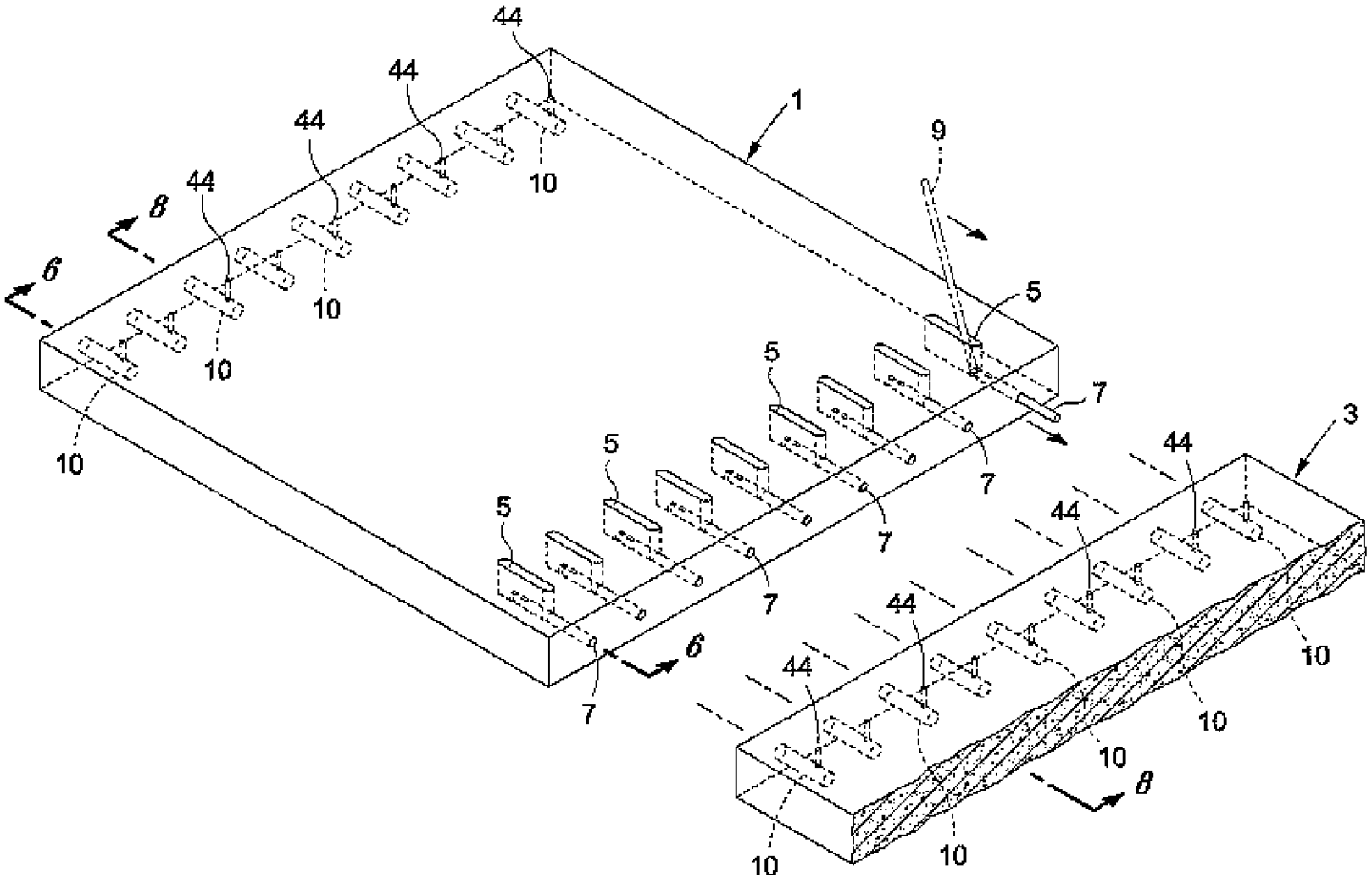
FIG. 1 shows a first pre-cast concrete panel having a plurality of connecting rods that are accessible through a plurality of slots so that the connecting rods can be pushed into slidable receipt by a corresponding plurality of mating channels formed in an adjacent panel, whereby the first and adjacent panels will be reliably joined together according to a preferred embodiment of this invention.

Referring initially to FIG. 1 of the drawings, an apparatus and a method are described for enabling a first concrete panel or slab 1 to be reliably joined to an adjacent panel or slab 3. The apparatus and method herein disclosed have particular application for use during roadway (e.g., freeway) construction and/or repair where a large number of heavy pre-cast concrete panels are laid end-to-end and/or side-by-side and connected to one another to create a smooth and continuous driveway over which vehicular traffic will travel. However, it is to be understood that the apparatus and method are applicable to the construction of any continuous surface such as a runway at an airport to be produced by a series of panels, slabs or the like that are manufactured from concrete or any other durable and wear-resistant material to be laid over a road bed or a similar support foundation. It is also to be understood that the panel (1 or 3) can be located at the intersection of adjacent panels that are laid end-to-end and side-by-side.

Each panel (e.g., 1) has a plurality of parallel-aligned deep slots 5 formed through the top and disposed along a first end thereof so as to lie opposite the adjacent panel 3 to which the first panel 1 will be joined. A plurality of connecting rods 7 are located within and slidable through the first end of panel 1. The plurality of slots 5 are ideally set back (i.e., spaced away) from the first end of the panel 1 so as to enable the placement or reinforcement bars (not shown) above and/or below the plurality of connecting rods 7. Each of the plurality of connecting rods 7 is accessible by way of a corresponding one of the plurality of slots 5. In particular, a hand-held tool 9, such as a thin bar, is inserted downwardly through each slot 5 formed in the panel 1 so as to engage the front end of the connecting rod 7. A pushing force applied to the tool 9 is transferred to the connecting rod 7 so as to cause the connecting rod to slide through the panel 1, whereby the opposite rear end of the connecting rod 7 is moved outwardly from the panel 1 towards the adjacent panel 3.

Each panel (e.g., 3) also has a plurality of parallel-aligned mating channels 10 formed along an end thereof which is opposite the first end of the panel along which the slots 5 are formed. It can be seen in FIG. 1 that the plurality of correcting rods 7 in the first panel 1 lie in axial alignment with respective ones of the plurality of mating channels 10 formed in the adjacent panel 3. Thus, the rear ends of the connecting rods 7 which are pushed outwardly from the panel 1 are slidable inwardly and into receipt by the axially-aligned mating channels 10 of the panel 3.

Figure 2:
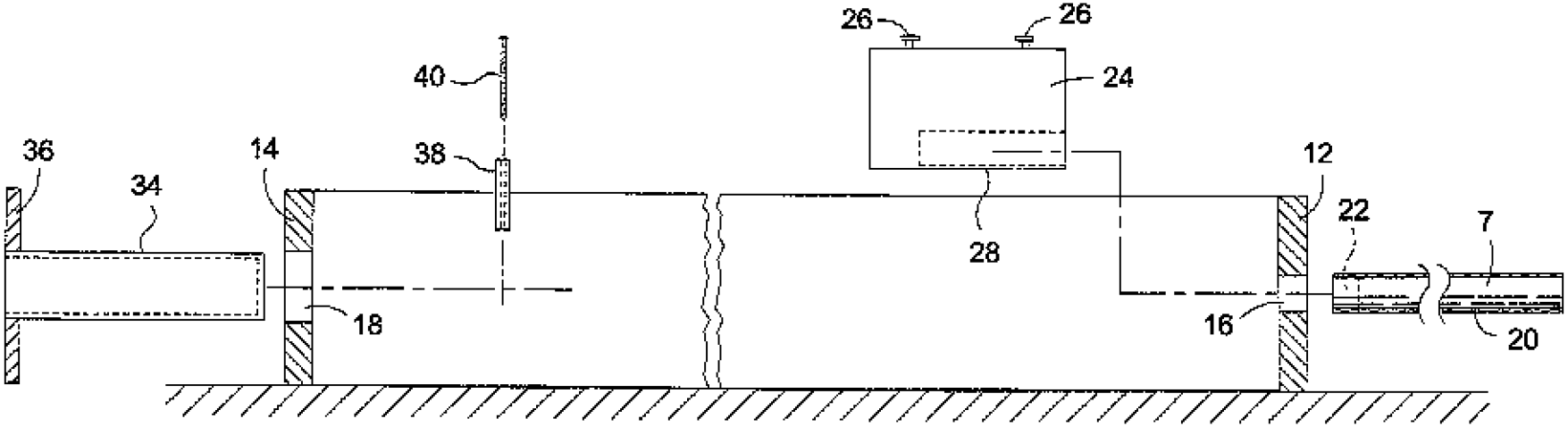
FIG. 2 illustrates the step of making a mold frame within which to manufacture the pre-cast concrete panel of FIG. 1.
Figure 3:
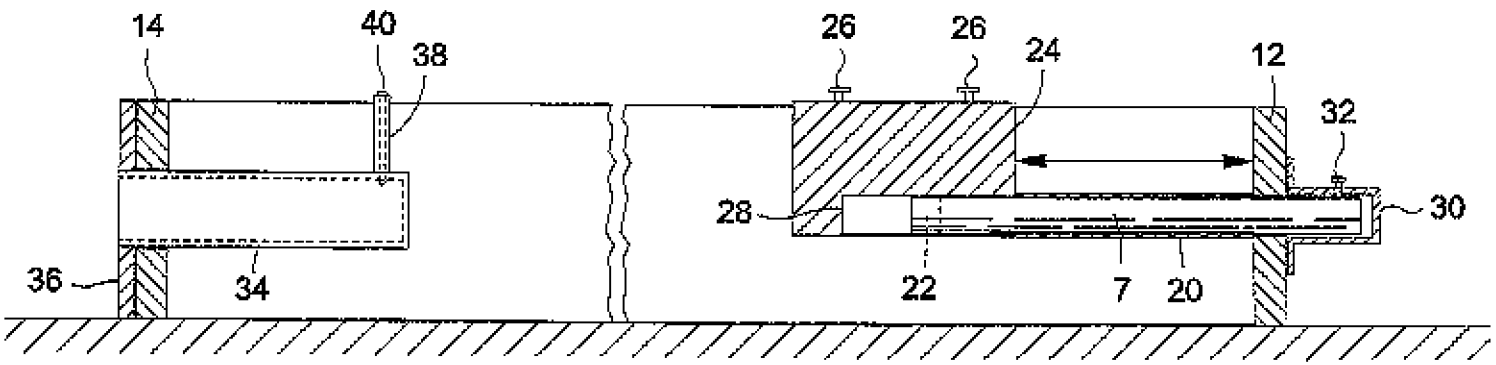
FIG. 3 illustrates the step of locating a connecting rod, a slot formation block and a depression cylinder within the mold frame of FIG. 2.

FIGS. 2-6 of the drawings show the concrete panel 1 during its steps of manufacture (i.e., casting) so that the aforementioned pluralities or slots 5 and mating channels 10 are formed therein. Turning first to FIGS. 2 and 3, the panel 1 is cast within a break-down mold frame that is commonly made from wooden boards 12 and 14. A hole 16 and 18 is formed through each board 12 and 14 of the frame. One of the plurality of connecting rods 7 is initially pushed towards and inwardly of the frame by way of the hole 16 through frame board 12. A portion of the connecting rod 7 is surrounded by a thin (e.g., plastic or nylon) sleeve 20 or liner which enables the connecting rod 7 to more easily slide through the panel 1 and outwardly therefrom towards an opposing mating channel 10 (of FIG. 1) in the adjacent panel 3 as will soon be explained. A small pocket 22 is formed in the front end of the connecting rod 7 in which to receive the tool 9 (also of FIG. 1).

A slot formation block 24 having lifting handles 26 located at the top thereof and a rod receiving cavity 28 at the front is positioned inside the frame so as to be suspended therein by means of the connecting rod 7. That is to say, the connecting rod 7 is pushed towards and into the mold frame via the hole 16 in the frame board 12 so that the front end of rod 7 slides inwardly of the rod receiving cavity 28 in the slot formation block 24 (best shown in FIG. 3). The slot formation block 24 is preferably manufactured from plastic or fiberglass and has a shape consistent with that of one of the plurality of deep slots 5 (of FIG. 1) formed in the top of the panel 1.

Once the connecting rod 7 is inserted into the rod receiving cavity 28 and the slot formation block 24 is seated on and suspended by rod 7, an end cap 30 is positioned in surrounding engagement with the rear end of the connecting rod 7 which remains outside the frame board 12. A locking fastener 32 is then moved through a hole in the end cap 30 and into locking engagement with the rear end of the connecting rod 7 that is surrounded by the end cap. The end cap 30 and the locking fastener 32 prevent the connecting rod 7 and the slot formation block 24 from shifting inside the mold frame as concrete is being poured therewithin to create the panel 1.

A depression cylinder 34 is pushed inside the mold frame by way of the hole 18 in the frame board 14. The depression cylinder 34 has a flat stop 36 which is attached flush against the outside of frame board 14 so that the cylinder 34 is held in opposite facing axial alignment with the connecting rod 7. An injection opening tube 38 is detachably connected to the top of the depression cylinder 34 by means of an optional fastener 40 that runs through the tube 38 and into mating engagement with the cylinder 34.

Figure 4:
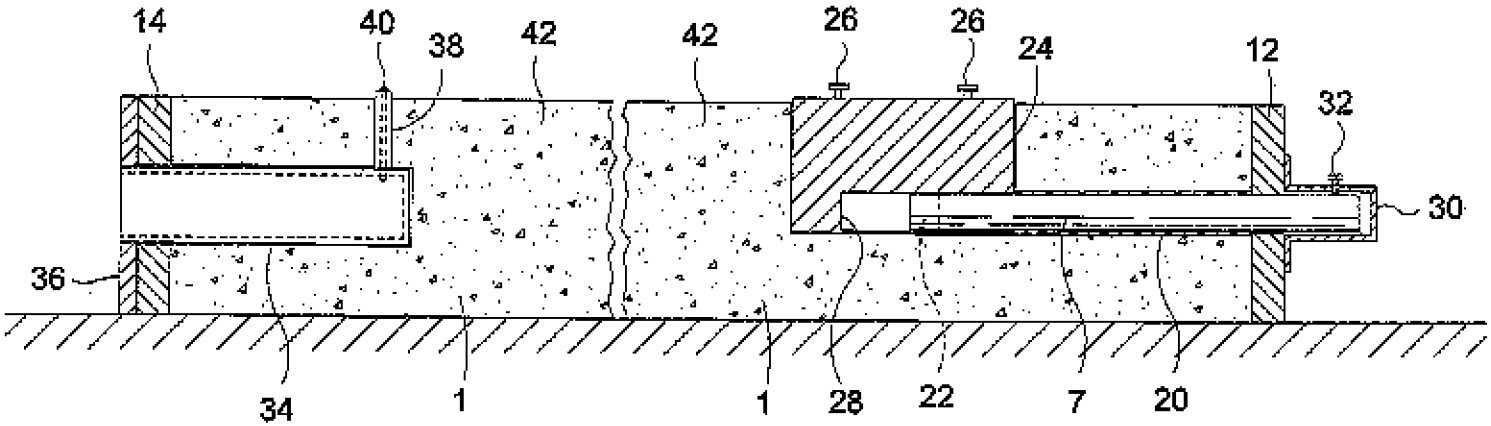
FIG. 4 illustrates the step of pouring concrete into the mold frame to surround the connecting rod, the slot formation block and the depression cylinder.

FIG. 4 of the drawing shows the formation of the panel 1 after concrete 42 has been poured into the mold frame between the frame boards 12 and 14. The concrete engulfs and surrounds the slot formation block 24, the sleeve 20 around connecting rod 7 and the depression cylinder 34 for a purpose that will now be described.

Figure 5:
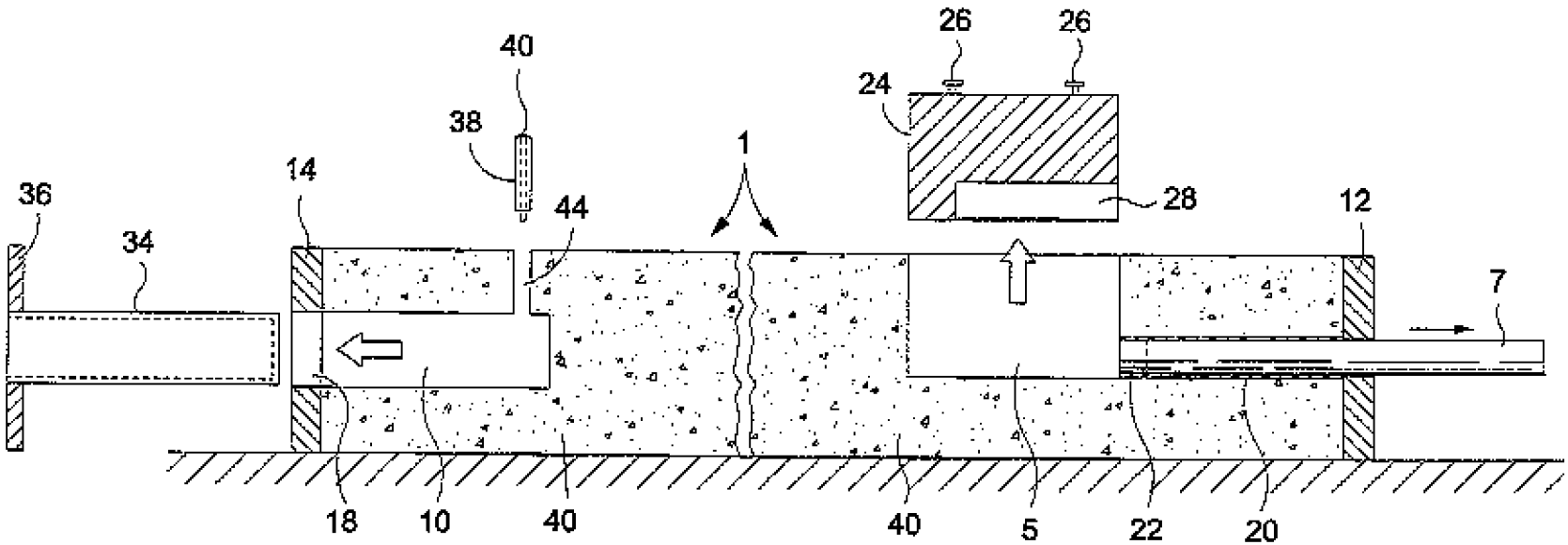
FIG. 5 illustrates the step of removing the slot formation block and the depression cylinder from the mold frame after the concrete has been poured.

Referring in this regard to FIG. 5 of the drawings, the concrete 42 within the mold frame begins to set so that both the slot formation block 24 and the depression cylinder 34 are suspended within the panel 1. The locking fastener 32 (of FIG. 4) is now removed so that the end cap 30 (also of FIG. 4) can be removed from the rear end of the connecting rod 7. The connecting rod 7 is then pulled partially out of the frame so that the front end of the rod 7 is withdrawn from the rod receiving cavity 28 of the slot formation block 24. To facilitate its displacement relative to the panel 1, the connecting rod 7 is slidable back and forth through the sleeve 20 which surrounds the rod 7 and remains stationary within the panel.

Prior to the concrete 42 of the panel 1 becoming fully cured, the slot formation block 24 is lifted up and out of the mold frame by applying a pulling force to the lifting handles 26 of block 24. To facilitate its removal, the slot formation block 24 may be covered with a mold release agent. Removing the slot formation block 24 results in the creation of one of the plurality of deep slots 5 which are formed through the top of the panel 1 so as to communicate with the plurality of connecting rods 7 as was previously described while referring to FIG. 1. The foregoing process is repeated until all of the slots 5 shown in FIG. 1 have been formed in the panel 1.

Next, the optional fastener 40 is removed so that the injection opening tube 38 can be separated from the depression cylinder 34 and withdrawn from the panel 1. The stop 36 is now detached from the frame board 14, and the depression cylinder 34 is pulled outwardly from the panel 1 via the hole 18 in the frame board 14. Removing the depression cylinder 34 and the injection opening tube 38 results in the creation of one of the plurality of mating channels 10 that is axially-aligned with one of the plurality of connecting rods 7 as was also described while referring earlier to FIG. 1. At the same time, an injection port 44 is established from the top of the panel 1 to the mating channel 10. The foregoing process is repeated until all of the mating channels 10 and the injection ports 44 which communicate therewith have been formed in the panel 1.

Figure 7:
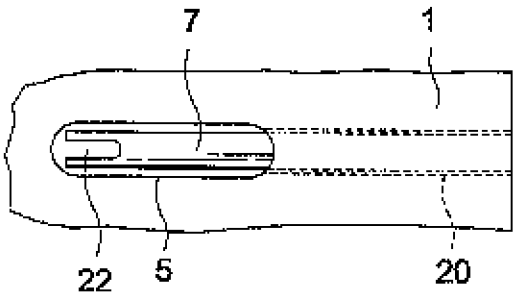
FIG. 7 is a top view of the concrete panel taken along lines 7-7 of FIG. 6 to show one of the plurality of slots of FIG. 1 and one of the plurality of connecting rods that is accessible therethrough.
Figure 6:
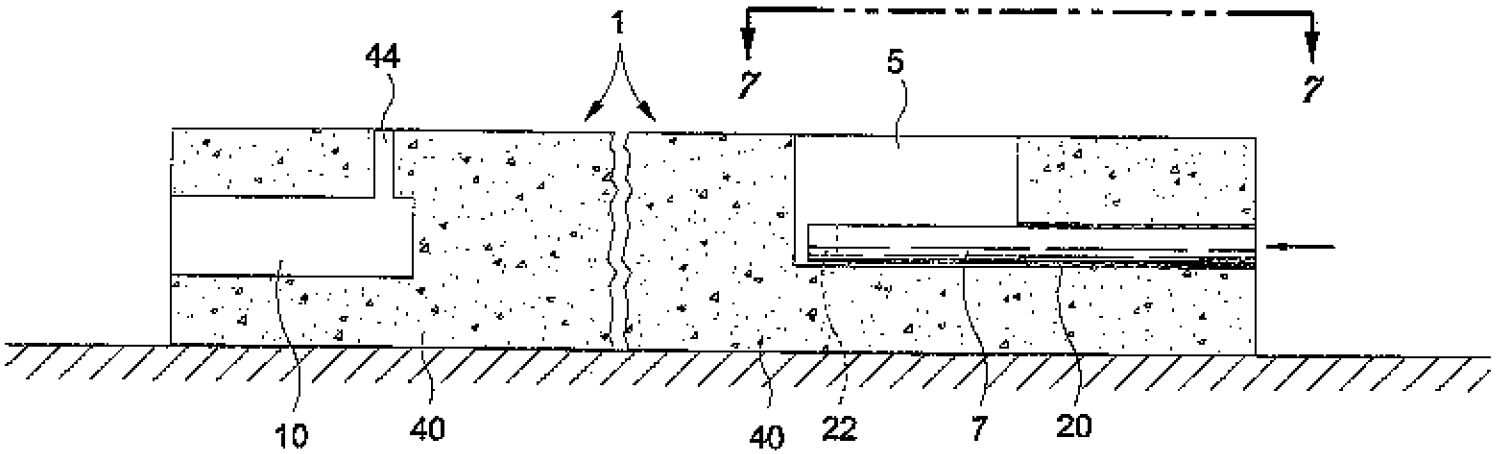
FIG. 6 shows the concrete panel after the mold frame has been detached from the panel and the concrete of the panel has cured and hardened.

FIG. 6 of the drawings shows the concrete panel 1 after the concrete 40 has cured and hardened. The frame boards (designated 12 and 14 in FIG. 5) have now been broken down and removed from the panel. The concrete around the slots 5, mating channels 10 and injection openings 44 formed in the panel 1 has correspondingly solidified. At this time, each connecting rod 7 is pushed inwardly through its sleeve 20 and entirely inside the panel 1 so that the front end of the rod 7 lies within one of the slots 5 through the top of the panel. It may therefore be appreciated that the panel 1 can be transported to a construction site and hoisted onto a road bed with the rods 7 already instated and retracted entirely within the panel so as to avoid a subsequent installation step common to those panels in which conventional dowel bar joints am employed. In this same regard, and as is best shown in FIG. 7, the connecting rod 7 is retracted inwardly so that the pocket 22 formed in the front end of the rod is accessible within the slot 5 formed through the top of the concrete panel 1.

Figure 8:
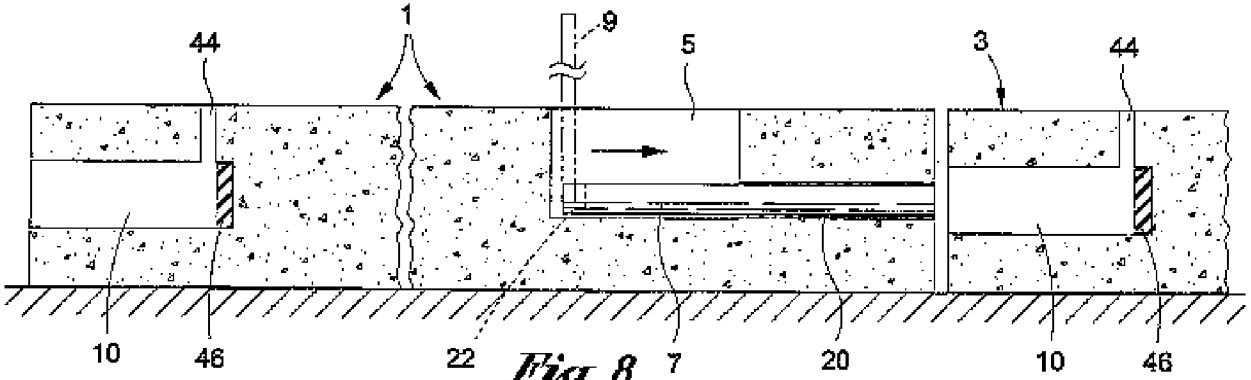
FIG. 8 illustrates the step or moving a tool through the slot of FIG. 7 for applying a pushing force to the connecting rod to cause the connecting rod to slide outwardly from the first panel into receipt by the adjacent panel.

FIG. 8 of the drawings shows the first concrete panel 1 positioned against the adjacent concrete panel 3 so that the panels can be joined together. More particularly, and as was previously explained, the panels 1 and 3 are arranged so that the plurality of connecting rods 7 from the first panel 1 are axially aligned with respective ones of the plurality of mating channels 10 of the adjacent panel 3. A resilient stop 46 is affixed at the end of each mating channel 10 formed in each of the panels 1 and 3. The stop 46 is preferably manufactured from a shock-absorbing resilient (e.g., rubber) material so as to function as a bumper against which the connecting rod 7 can move once the pair of adjacent panels 1 and 3 have been joined together.

FIG. 8 also shows the hand-held tool 9 (of FIG. 1) inserted downwardly through one of the plurality of slots 5 formed in the first concrete panel 1. The tool 9 is received within the pocket 22 formed in the front end of one of the connecting rods 7 which is accessible through the slot. A pushing force applied to the tool 9 causes the connecting rod 7 to slide through its sleeve 20 such that the rear end of rod 7 moves outwardly from the first panel 1 and into the axially-aligned mating channel 10 of the adjacent panel 3. This process is repeated until all of the connecting rods 7 from the first panel 1 have been pushed into receipt by the mating channels 10 of the adjacent panel 3.

Figure 9:
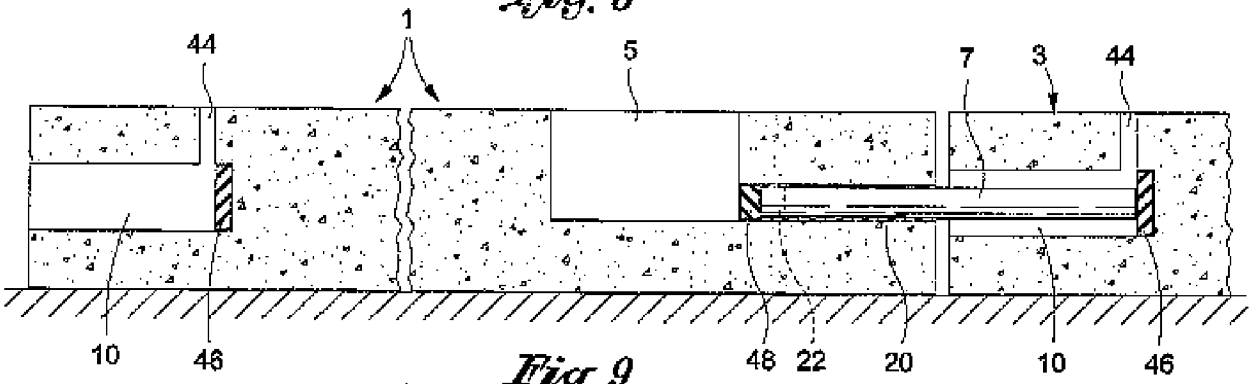
FIG. 9 shows the first and adjacent concrete panels of FIG. 1 being joined end-to-end one another by means of the plurality of connecting rods shown in FIG. 1.

FIG. 9 of the drawings shows the connecting rod 7 of FIG. 8 after the rear end of the rod 7 has been pushed outwardly from the first panel 1 and into receipt by the opposing mating channel 10 of the adjacent panel 3. The tool 9 of FIG. 8 can now be withdrawn from the slots 5 or the first panel 1. A second resilient shock-absorbing bumper or stop 48 is shown after being moved downwardly through the slot 5 and affixed in place against the front end of connecting rod 7. The resilient stops 46 and 48 are located at opposite ends of connecting rod 7 so as to be capable of dissipating internal pressures and mechanical forces generated by the rod in the event that the adjacent panels 1 and 3 were to move together or apart due to environmental changes following installation. The internal connecting rods 7 and the resilient stops 46 and 48 cooperate to maintain the structural integrity of the joint that is established by the connecting rod 7 extending between the first and adjacent concrete panels 1 and 3.

Figure 10:
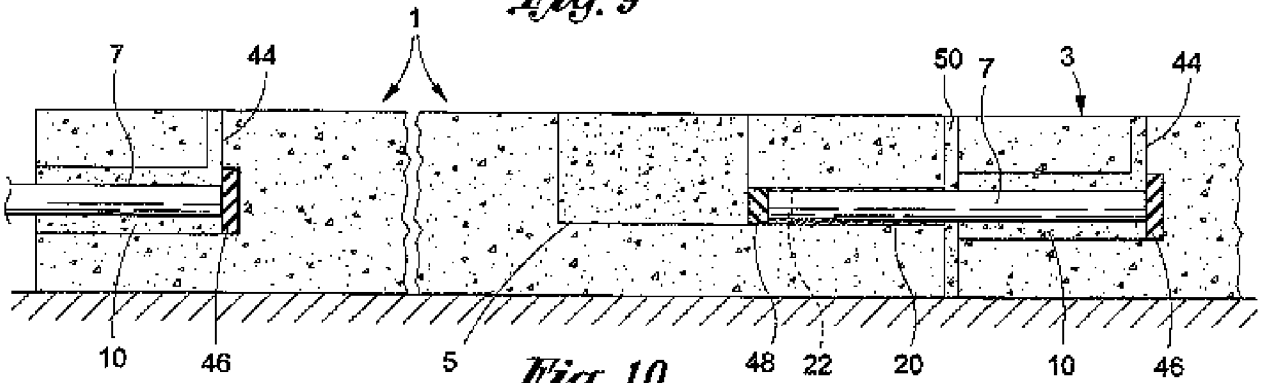
FIG. 10 shows the first and adjacent concrete panels joined together after the pluralities of slots and mating channels have been pumped full of a filler material.

FIG. 10 of the drawings shows the first and adjacent concrete panels joined together after the plurality of connecting rods 7 from the first panel 1 have been moved into receipt by respective ones of the plurality of mating channels 10 of the adjacent panel 3. In order to create a smooth continuous roadway over which vehicular traffic can travel, each slot 10 at the top of the first panel 1 is pumped full of concrete, grout, an epoxy resin, etc. Following this, each mating channel 10 through the adjacent panel 3 is also filled with concrete, grout or any other suitable filler material via the respective injection ports 44 which communicate therewith. The injection ports 44 themselves are now filled and sealed. Finally, any gap 50 between opposing ends of the adjacent concrete panels 1 and 3 is likewise filled and sealed.

It may be appreciated that the connecting rods 7 are retained in place extending between the concrete panels 1 and 3, because the rods 7 are deeply embedded within the panels and positioned between the resilient stops 46 and 48. By virtue of the foregoing, gaps are unlikely to form between adjacent panels, and the connecting rods are unlikely to pop out and separate from the panels which could impact the reliability of the joint as may otherwise be the case when conventional surface-mounted dowel bars are used to couple adjacent roadway panels together. As was explained while referring to FIG. 9, and as an important advantage provided by the connecting rods 7 being embedded within adjacent panels 1 and 3 and running between resilient stops 46 and 48, the panels 1 and 3 will be able to move or shift slightly without buckling or cracking in response to thermal expansion or contraction. That is to say, the adjacent panels 1 and 3 can slide back and forth along the rods 7 with the stops 46 and 48 being positioned to absorb the corresponding pushing forces imparted to the rods.

It may also be appreciated that the size of the slots 5 through the top of the concrete panel 1 which communicate with respective ones of the connecting rods 7 can vary to accommodate tools other than the tool (designated 9) shown in the drawings. In fact, the slots 5 may be widened so that a workman's hand can be inserted therethrough in order to manually exert a pushing force against the rods 7 to cause the rods to slide outwardly from the first concrete panel 1 into receipt by the adjacent concrete panel 3. In the alternative, the width of the slots 5 can be minimized (e.g., to approximately 1 inch) so that the slots need not be loaded with a filler material as was earlier described.

The invention claimed is:

1. A method for joining a first concrete panel to an adjacent second concrete panel to establish a continuous path of travel over the first and adjacent panels, said method comprising the steps of:

forming a plurality of slots in said first panel;

locating a plurality of connecting rods within said first concrete panel so that each of said connecting rods is accessible by way of one of said plurality of slots in said first panel;

forming a corresponding plurality of mating channels within said adjacent second concrete panel, such that said plurality of connecting rods are axially aligned with respective ones of said plurality of mating channels;

moving a tool through one of said plurality of slots and into contact with a corresponding one of said plurality of connecting rods; and pushing said tool towards said one connecting rod for applying a force to said one connecting rod and thereby causing said connecting rod to slide through the first concrete panel so that said one connecting rod extends outwardly from the first concrete panel and inwardly of the adjacent second concrete panel at a respective one of said plurality of mating channels formed therewithin, whereby said first and adjacent second concrete panels are joined to one another.

2. The method recited in claim 1, comprising the additional step of filling said pluralities of slots and mating channels with a filler material after at least some of said plurality of connecting rods have been caused to slide through said first concrete panel and inwardly of the adjacent second concrete panel at respective ones of said plurality of mating channels formed therein so that the at least some of said connecting rods are embedded within said first and said adjacent second concrete panels.

3. The method recited in claim 1, comprising the additional steps of forming a pocket in each of said plurality of connecting rods; and locating said tool within said pocket during the step of moving said tool through one of said plurality of slots and into contact with a corresponding one of said plurality of connecting rods.

4. The method recited in claim 1, wherein said plurality of slots in said first concrete panel are formed by the steps of:

assembling a frame in which concrete is to be poured to make said first concrete panel;

suspending a plurality of slot formation blocks within said frame prior to the pouring of the concrete;

pouring the concrete into said frame to surround said plurality of slot formation blocks;

removing said plurality of slot formation blocks from said frame prior to the concrete poured therein hardening so that said plurality of slots extend through said first concrete panel and communicate with respective ones of said plurality of connecting rods located within said first panel; and allowing the concrete poured into said frame to harden.

5. The method recited in claim 4, comprising the additional step of suspending said plurality of slot formation blocks within said frame by seating said slot formation blocks on respective ones of said plurality of connecting rods located within said first panel.

6. The method recited in claim 4, comprising the additional steps of attaching a lifting handle to each of said plurality of slot formation blocks; and applying a lifting force to each lifting handle during the step of removing said plurality of slot formation blocks from said frame.

7. The method recited in claim 1, wherein said plurality of mating channels in said adjacent second concrete panel are formed by the steps of:

assembling a frame in which concrete is to be poured to make said adjacent second concrete panel;

locating a plurality of depression cylinders within said frame prior to the pouring of the concrete so that said depression cylinders are axially aligned with respective ones of said plurality of connecting rods within said first concrete panel;

pouring the concrete into said frame to surround said plurality of depression cylinders;

removing the plurality of depression cylinders from said frame prior to the concrete panel therein hardening; and allowing the concrete poured into said frame to harden.

8. The method recited in claim 7, comprising the additional steps of forming a plurality of filler injection ports through said adjacent second concrete panel to communicate with respective ones of said plurality of mating channels; and filling said mating channels with a hardening material by way of said injection ports after at least some of said plurality of connecting rods slide through and extend outwardly from said first concrete panel and inwardly of said adjacent second concrete panel at said plurality of mating channels formed therewithin so that the at least some of said connecting rods are embedded within said mating channels.

9. The method recited in claim 1, comprising the additional step of positioning a resilient bumper at each end of each of said plurality of connecting rods so as to absorb forces imparted to said connecting rods should said first and adjacent panels slide along said connecting rods in response to thermal expansion or contraction after said panels have been joined to one another.

10. A combination, comprising:

a first panel having a plurality of slots formed therein;

a plurality of connecting rods slidable through said first panel;

a second panel;

a plurality of mating channels formed in said second panel and axially aligned with respective ones of said plurality of connecting rods of said first panel; and a tool by which a force is applied to at least some of said plurality of connecting rods to cause said connecting rods to slide through said first panel so that said connecting rods extend outwardly from said first panel for receipt inwardly of said second panel within respective ones of said plurality of mating channels formed therein, whereby said first and second panels are joined to one another, said tool comprising an elongated bar that is sized to be inserted downwardly through one of said plurality of slots and pushed into contact with a corresponding one of the at least some of said plurality of connecting rods for applying a pushing force to said one connecting rod and thereby causing said one connecting rod to slide through said first panel for receipt by an axially-aligned one of said plurality of mating channels formed in said second panel.

11. The combination recited in claim 10, wherein each of said plurality of connecting rods has a pocket formed therein, said elongated bar being inserted downwardly through the one of said plurality of slots of said first panel and into contact with the corresponding one of the at least some of said plurality of connecting rods at the pocket thereof.

12. A method for joining a first panel to an adjacent panel to establish a continuous path of travel over the first and adjacent panels, said method comprising the steps of:

forming at least one slot in said first panel;

locating at least one connecting rod within said first panel, and forming a pocket in said connecting rod which is accessible by way of said one slot;

forming at least one mating channel within said adjacent panel such that said one connecting rod is axially aligned with said one mating channel; and exerting a pushing force on said one connecting rod at the pocket formed therein by way of said one slot for causing said one connecting rod to slide through the first panel such that said connecting rod extends outwardly from said first panel and inwardly of the adjacent panel for receipt at said one mating channel formed therein, whereby said first and adjacent panels are joined to one another.

13. The method recited in claim 12, comprising the additional steps of exerting said pushing force on said one connecting rod by inserting a bar through said one slot and into the pocket formed in said one connecting rod, and removing said bar from said slot when said first and adjacent panels are joined to one another.

14. The method recited in claim 12, comprising the additional steps of exerting said pushing force on said one connecting rod by a workman inserting his hand through said one slot and into the pocket formed in said one connecting rod, and the workman removing his hand from said slot when the first and adjacent panels are joined to one another.

15. The method recited in claim 12, comprising the additional step of positioning a resilient bumper at opposite ends of said at last one connecting rod so as to absorb forces imparted to said one connecting rod during and after said connecting rod sliding through said first panel for receipt by the axially-aligned mating channel formed within said adjacent panel.

16. The method recited in claim 12, comprising the additional step of filling said at least one slot formed in said first panel with a hardening material after said at least one connecting rod slides through said first panel for receipt by the axially-aligned mating channel formed within said adjacent panel.

* * * * *